United States Patent [19]

Arikawa

[11] Patent Number: 4,527,144

[45] Date of Patent: Jul. 2, 1985

[54] THERMAL CUT-OFF DEVICE

[75] Inventor: Hiroo Arikawa, Setagaya, Japan

[73] Assignee: S.O.C. Corporation, Tokyo, Japan

[21] Appl. No.: 550,001

[22] Filed: Nov. 8, 1983

[30] Foreign Application Priority Data

Nov. 11, 1982 [JP] Japan ..... 57-169869[U]

[51] Int. Cl.[3] ..... H01H 37/76

[52] U.S. Cl. ..... 337/407; 337/403

[58] Field of Search ..... 337/407, 403, 408

[56] References Cited

U.S. PATENT DOCUMENTS 4,186,366 1/1980 McVey ..... 337/407

4,255,736 3/1981 Kelley et al. ..... 337/407

*Primary Examiner*—Harold Broome

[57] ABSTRACT

A thermal cut-off device comprises a casing and a cover therefor both made of a highly heat conductive electrically insulating material such as ceramic. A pair of lead wires protrude from opposite ends of the casings with the other ends of the wires being electrically connected to an electrical assembly within the casing. The electrical assembly comprises a leaf spring, a conductive fixed terminal and a plastic mass for biasing the leaf spring so as to contact the fixed terminal during closed circuit condition. A helical spring in the casing stabilizes the leaf spring upon its release when the plastic mass melts due to overheating.

8 Claims, 6 Drawing Figures

THERMAL CUT-OFF DEVICE

FIELD OF THE INVENTION

This invention relates to a thermal cut-off device and is particularly related to a thermally responsive electrical cut-off device used to protect electrical equipment from over-heating, damage and destruction by fire.

BACKGROUND OF THE INVENTION

Protective devices are frequently used to protect electrical equipment from damage and guard against fire caused by overheating of the equipment. These devices are sometimes referred to as "thermal cut-off" since they are responsive to overheating and can interrupt the electric flow to guard against damage or fire.

Conventional thermal cut-off devices usually comprise a generally tubular heat-conductive body or casing having electrically conductive lead wires wherein each of said wires has an end protruding from the casing for connection to an electrical circuit, while their other ends are within the casing and are in contact with one another during the closed circuit conditions. The contacting ends may be held together by a fusible metal ring or solder, or a fusible plastic mass may be disposed within the casing which, at closed circuit conditions, biases one end of one of the lead wires to contact the end of the other lead wire. When the device is electrically connected to the electrical equipment which is to be protected, it will become heated due to passage of electric current, and if the casing temperature exceeds the melting point of the plastic, or the fusion point of the metal ring or solder, the plastic mass, the metal ring or the solder, as may be the case, will melt or will at least soften sufficiently to disengage the contacting ends of the lead wires, and hence interrupt further flow of electricity by opening the circuit.

The prior devices, however, have not been satisfactory due to one or more deficiencies which will become apparent from the ensuing detailed description of the present invention.

Accordingly, it is an object of this invention to provide an improved thermally responsive electrical cut-off device.

It is also an object of this invention to provide such thermal cut-off device which can rapidly and effectively protect electrical equipment against damage or fire caused by overheating due to excessive flow of electrical current.

It is a further object of this invention to provide such a protective device which prevents re-establishment of the current flow once the circuit has been opened.

The foregoing objects and other features and advantages of this invention will be appreciated from the following detailed description and the drawings.

SUMMARY OF THE INVENTION

In accordance with this invention, a thermal cut-off device is provided which comprises a casing and a cover therefor both made of a highly heat conductive, electrical insulating material such as ceramic. A pair of conductive wires protrude from the casing for connection to a PCB or other electrical equipment. The other ends of the wires are connected to the electrical assembly in the casing. The electrical assembly comprises a metal leaf spring, a conductive fixed terminal at one end of the casing and mass of plastic material which, in normal state, biases the leaf spring to contact the fixed terminal. A helical spring disposed between the leaf spring and the inside wall of the casing serves to cooperate with the leaf spring to stabilize it upon its release when the plastic mass is melted due to passage of electrical current.

BRIEF DESCRIPTION OF THE DRAWINGS

In the drawings, wherein like reference numerals are employed to designate like parts.

DETAILED DESCRIPTION OF THE INVENTION

Figure 1:
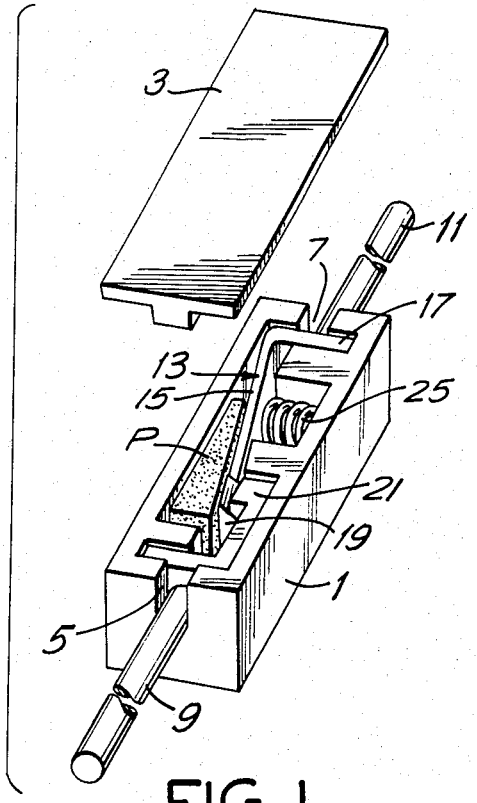
FIG. 1 is a perspective view of the device of this invention, with its cover removed, illustrating the arrangement and cooperation of its various parts during closed circuit condition.

Referring to FIG. 1, the device of this invention comprises a body or casing 1 and a cover 3, both made of a highly heat conductive and electrically insulating material such as ceramic.

The casing 1 houses the electrical assembly used in the present invention and has openings 5 and 7 at its respective ends through which protrude lead wires 9 and 11. The lead wires 9 and 11 are disposed within the casing and each has an end which protrudes from the casing 1 and is adapted to be connected to an electric circuit such as a printed circuit board (PCB), not shown in the drawing. The other end of each of the lead wires 9 and 11 are connected to the electrical assembly within casing 1 as will be further described hereinafter.

Figure 3:
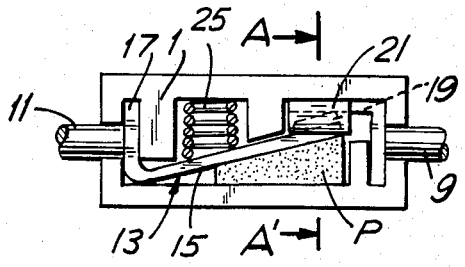
FIG. 3 is a top view of the device shown in FIG. 1 without the cover.
Figure 5:
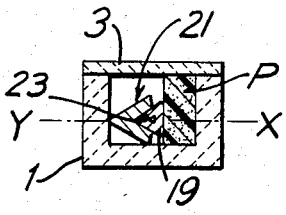
FIG. 5 is a transverse sectional view taken along the line A—A′ of FIG. 3.

A spring leaf 13 is disposed within the casing 1 and consists of an elongated portion 15 extending generally in the longitudinal direction of the device, and a foot portion 17 formed at approximately 90 degrees angle relative to the elongated portion 15. The foot portion 17 is securely placed within a recess in the casing and is in fixed contact with the lead wire 11. At its other end, the elongated portion 15 of the leaf spring is shaped into a generally knife-blade form 19 (see FIGS. 3 and 5), the function of which will be further explained. A plastic mass P is disposed in the casing 1 as shown in FIG. 1. Plastic mass P serves to bias the elongated portion 15 of the leaf spring toward a fixed terminal 21. The fixed terminal 21 has a generally V-shaped groove 23 whose angle is slightly more obtuse than the angle of the knife-blade 19 such that the knife-blade 19 is telescopically engaged into the V-shaped groove 23 during closed circuit condition as shown in FIG. 5. The fixed terminal 21 is connected to the lead wire 9 thus forming a closed circuit to permit the flow of electricity through the device.

A coiled or helical spring 25 is disposed within the casing 1 as shown in FIG. 1 and serves the dual function of pressing against the elongated portion 15 of the leaf spring to retain it in position initially, and to ensure its proper release in order to prevent the leaf spring from vibrations after its release when the plastic mass P melts or softens sufficiently.

In operation, the temperature responsive electrical cut-off link of this invention is electrically connected to a PCB or any other equipment which is to be guarded against damage due to excessive current flow and overheating. When the temperature in the casing 1 exceeds a predetermined rated temperature which is higher than the melting point or fusion point of the plastic mass P, the plastic will melt or will sufficiently soften, thus losing its compressive force against the leaf spring. Accordingly, the elongated portion 15 of the leaf spring will be released while its foot portion 17 remains fixed and in contact with the lead wire 9. As the leaf spring is released, the coiled spring 25 expands and thus presses against the elongated portion 15 and prevents the leaf spring from further vibrations after its initial bounce due to its sudden release. The circuit is thus opened and no further electricity flows through the electrical assembly in casing 1.

Figure 2:
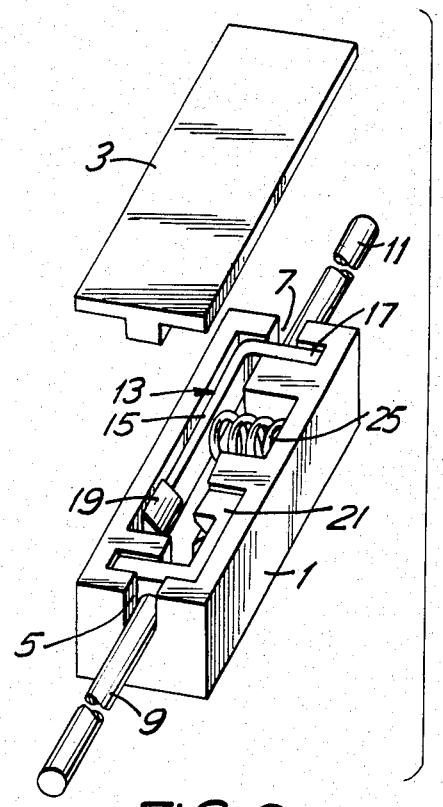
FIG. 2 is a perspective view similar to FIG. 1 but illustrates the arrangement and cooperation of the various parts during open circuit condition.
Figure 4:
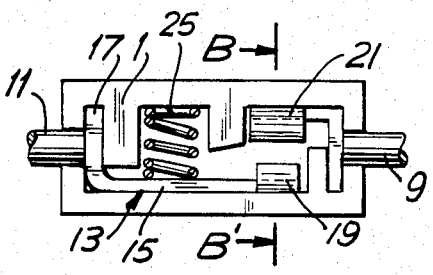
FIG. 4 is a top view of the device shown in FIG. 2 without the cover.
Figure 6:
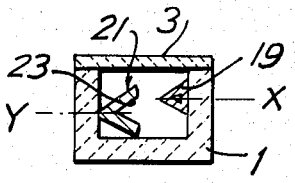
FIG. 6 is a transverse sectional view taken along the line B—B′ of FIG. 4.

FIGS. 2 and 4 illustrate the arrangement of the electrical assembly in the casing 1 during open circuit condition. As the circuit is opened, the knife-blade 19 will disengage from the V-shaped groove 23 of fixed terminal 21. Not only the knife-blade 19 disengages from the V-shaped groove 23 but it will also be displaced relative thereto. Thus, as shown in FIG. 6, the knife-blade 19 is disposed so that the cross sectional center line X of the knife-blade 19 does not have a common center line with the cross sectional center line Y of the V-shaped groove 23 when the spring leaf 13 is released. This prevents re-engagement of the knife-blade 19 into the V-shaped groove 23 after the spring leaf 13 has been released which would otherwise re-establish the electrical circuit.

Thus, it can be appreciated from the foregoing description that the protective device of this invention offers several advantageous features. First, it affords increased contact pressure at the contact surface by employing a restoring force with which the leaf spring 13 cooperates to a stabilized position.

Second, it provides a larger contact area which reduces the contact resistance, therefore reducing the possibility of overheating at the contact surface.

Third, it prevents re-establishment of the circuit which may otherwise occur by re-engagement of the knife-blade 19 into the V-shaped groove 23 of terminal 21 when the leaf spring 13 vibrates after its initial release.

As it is evident from the foregoing detailed description, several obvious changes and/or modifications may be made in the structure of the protective device of this invention. Such changes and modifications are nevertheless within the scope and contemplation of this invention.

What is claimed is:

1. A temperature responsive electrical cut-off device comprising a casing and a cover for said casing both made of a highly heat conductive, electrically insulating material, an electrical circuit assembly within said casing, a pair of electrically conductive wires having ends protroding from said casing for connection into an exterior electrical circuit board, the other ends of said wires being connected to said electrical assembly in said casing, said electrical assembly including a conductive fixed terminal, a metal leaf spring having an intermediate elongated portion extending axially in said casing, a bent foot portion securely positioned at one end of said casing and a head portion in knife-blade form at the other end of said casing in contact with said fixed terminal; said fixed terminal having a generally V-shaped groove whose angle is sufficiently more obtuse than the angle of said knife-blade, thereby enabling said V-shaped groove to consummate a closed circuit; a mass of plastic material which melts at a predetermined temperature, said mass of plastic material biasing said leaf spring toward said fixed terminal during closed circuit condition; a helical spring normally compressed between said leaf spring and said casing, said helical spring cooperating with said leaf spring when said leaf spring is released upon melting of said plastic material to stabilize said leaf spring.

2. A device as in claim 1 wherein the axis is of said knife-blade is offset relative to the axis of said V-shaped groove of the fixed terminal when said leaf spring is released.

3. A device as in claim 1 wherein one end of said conductive wires in said casing is electrically connected to said leaf spring and the end of the other lead wire in said casing is connected to said fixed terminal.

4. A device as in claim 2 wherein one end of said conductive wires in said casing is electrically connected to said leaf spring and the end of the other lead wire in said casing is connected to said fixed terminal.

5. A device as in claim 1 wherein said casing comprises a recess and said foot portion of said leaf spring is securely positioned in said recess.

6. A device as in claim 2 wherein said casing comprises a recess and said foot portion of said leaf spring is securely positioned in said recess.

7. A device as in claim 3 wherein said casing comprises a recess and said foot portion of said leaf spring is securely positioned in said recess.

8. A device as in claim 4 wherein said casing comprises a recess and said foot portion of said leaf spring is securely positioned in said recess.

* * * * *